United States Patent [19]

Westhead

[11] Patent Number: 4,467,839

[45] Date of Patent: Aug. 28, 1984

[54] PAPERMAKERS FABRIC USING DIFFERENTIAL MELT YARNS

[75] Inventor: William T. Westhead, Waycross, Ga.

[73] Assignee: Scapa Inc., Waycross, Ga.

[21] Appl. No.: 258,046

[22] Filed: Apr. 28, 1981

[51] Int. Cl.[3] ..... D03D 25/00

[52] U.S. Cl. ..... 139/383 A; 139/425 A; 428/247; 428/252; 428/259; 428/288

[58] Field of Search ..... 139/383 A, 383 AA, 425 A; 428/257, 258, 259, 288, 246, 247, 252, 255, 104, 234, 235, 300

[56] References Cited

U.S. PATENT DOCUMENTS

| | | | |
|---|---|---|---|
| 4,126,499 | 11/1978 | Payen | 156/148 |
| 4,143,197 | 3/1979 | Jasionowicz | 428/257 |
| 4,151,323 | 4/1979 | Christie | 428/235 |
| 4,187,618 | 2/1980 | Diehl | 428/235 |
| 4,224,372 | 9/1980 | Romanski | 428/257 |
| 4,259,394 | 3/1981 | Khan | 139/383 A |
| 4,290,209 | 9/1981 | Buchanan et al. | 139/383 A |
| 4,298,643 | 11/1981 | Miyagawa et al. | 428/257 |
| 4,351,874 | 9/1982 | Kirby | 428/229 |

*Primary Examiner*—William J. Van Balen

*Attorney, Agent, or Firm*—Fleit, Jacobson, Cohn & Price

[57] ABSTRACT

A papermakers fabric woven in accordance with a preselected weave pattern. The fabric has a top surface, a bottom surface, and a center plane interposed between the top and bottom surfaces. The fabric is woven using high melting point or high degradation temperature synthetic warp yarns and similarly high melting point or high degradation temperature synthetic top and bottom weft yarns. The weft yarns in the center plane are lower melting point synthetic yarns. During heat stabilization, the fabric is exposed to sufficient heat to cause the low melting point stuffer yarns to melt and flow, and to reform in such a way that they fill to a desired extent the voids in the weave pattern where they have been inserted, thus, reducing permeability. The flow of the molten synthetic stuffer pick around and between the unmelted warp and weft yarns bonds the whole structure together, thereby improving fabric stability. Finally, because the melted stuffer pick acts as a monofilament yarn, the fabric tends to run cleaner.

18 Claims, 7 Drawing Figures

PAPERMAKERS FABRIC USING DIFFERENTIAL MELT YARNS

BACKGROUND OF THE INVENTION

1. Field of the Invention

The present invention relates to papermakers fabrics, in general, and to dryer fabrics incorporating meltable yarns, in particular.

2. Background of the Prior Art

A conventional dryer felt or fabric consists of an endless conveyor belt, typically made from a two, three or more plane fabric, wherein the various planes are defined by different groups of cross-machine direction yarns. The planes, plies, or layers, as they are various called, are united by a plurality of machine direction yarns.

The yarns used to weave the most up-to-date dryer fabrics are generally made from synthetic monofilaments or synthetic multifilaments, from such materials as polyester or polyamide. Dryer felts made exclusively from monofilament yarns have certain drawbacks. Because the monofilament yarns are relatively stiff, they are not easily bent around each other during the weaving process. Thus, the fabric which results has a relative open structure. There are a number of positions on the papermaking machine that do not run or cannot run effectively when employing a very open fabric because of numerous problems with the paper sheet, such as thread-up, blowing, and flutter which causes sheet breaks.

A number of attempts to reduce the openness or permeability of dryer fabrics made predominantly of monofilaments have been tried. The major approach has been to use a bulky spun yarn as a stuffer pick in the middle of the weave pattern. These stuffer picks are, in effect, surrounded by the original monofilament cross-machine direction picks, which are positioned in both the face and back surfaces of the fabric. This approach has been successful in reducing permeability, but has added little or nothing to the stability of the fabric. It has also created the disadvantage that the spun stuffer pick is prone to collect dirt. Also, the stuffer picks have a tendency to retain and carry moisture, a condition which is undesirable. Therefore, a low permeability monofilament fabric produced with a spun stuffer pick runs wetter and gets dirty relatively quickly, compared to a high permeability all monofilament product.

A second approach has been to modify the weave structure in such a way that the top or face cross-machine direction picks are offset in relation to the bottom or back cross-machine direction picks. Although this approach has produced relatively low permeability in an all monofilament fabric, there is no easy way to change permeability. The weave design does not permit the use of stuffer picks. Therefore, the only changes are reducing the pick level from maximum (the number of weft or cross-machine direction yarns per inch), which, in turn, reduces the stability, or changing the number of warp or machine direction ends per inch, which necessitates redrawing the loom. Changes in yarn diameter are, of course, possible, but such changes can only be made within the limitations of the loom.

Yet another example of a way to obtain low permeability in a dryer felt is the incorporation of warp yarns of rectangular cross-section into a weave pattern that does not include provision for stuffer picks. In such a weave pattern, the warp yarn typically floats on the paper-receiving surface of the fabric over a number of weft picks. The longer the float, i.e., the more picks the warp yarn crosses before weaving back into the fabric, the less stable the fabric becomes. In this way, there is a tradeoff between permeability and fabric stability.

There is thus a need for papermakers fabric which may be easily and economically produced to provide a wide permeability range, which is stable and also dirt resistant, and which exhibits reduced moisture carrying properties. The present invention is directed toward filling that need.

SUMMARY OF THE INVENTION

The present invention relates to a dryer felt or fabric of low permeability with retained stability and marked dirt resistance. In a preferred embodiment, the dryer fabric is one which has a face or top surface, a bottom or back surface, and a center plane located between the top and bottom surface within the weave structure. In order to produce such a structure, a plurality of machine direction yarns are interwoven with selected pluralities of cross-machine direction yarns in a predetermined manner in accordance with a preselected weave pattern. As used herein, the terms "machine direction" and "cross-machine direction" refer to the yarns in the fabric in their positions of intended use on a papermaking machine.

The face or top surface of the fabric is defined by a first plurality of cross-machine direction yarns. The bottom or back surface of the fabric is defined by a second plurality of cross-machine direction yarns. Finally, the center plane is defined by a series of stuffer pick receiving sheds, all or some of which, depending on the desired permeability of the fabric, contain a stuffer yarn.

In a preferred embodiment, the fabric is woven using high melting point synthetic monofilament or multifilament machine direction yarns and similarly high melting point synthetic monofilament or multifilament cross-machine direction yarns to define the top and bottom surfaces. The cross-machine direction yarns in the center plane are made up of lower melting point synthetic yarns in the form of monofilament yarns, multifilament yarns, slit synthetic film tape, split synthetic film tape of combinations thereof.

After weaving, and during a conventional heat stabilization process, the dryer fabric is exposed to sufficient heat to cause the low melting point cross-machine direction yarns in the center plane to melt and flow. The heat, however, is below the softening point of the high melting point yarns.

After the fabric has been subjected to heat treatment, the cross-machine direction stuffer yarns have melted, flowed and reformed in such a way that the stuffer pick receiving sheds are substantially filled. The act of filling these holes or cavities in the fabric reduces permeability. At the same time, the flow of the molten synthetic stuffer pick around and between the unmelted machine and cross-machine direction yarns bonds the whole structure together, thereby improving fabric stability. Because each of the cross-machine direction stuffer yarns, after melting, reforms into a solid mass with a smooth surface, it behaves like a monofilament in relation to dirt on the paper machine.

After melt and flow, the individual low melt yarns basically stay as individual yarns. Primarily, this is because the sheds formed by the machine direction yarns act like tubes and act to prevent the flow of one melted yarn from one shed to another. In addition, when the yarns melt and flow, the material remains very viscous and does not readily move to flow outside of the shed or tube.

In other embodiments of the subject invention, alternative stuffer picks and warp yarns are employed. For example, in some applications, the synthetic film yarns are replaced with stuffer yarns having an inextensible core about which is wrapped the low melting point material in the form of a monofilament, multifilament, or film yarn. In yet other applications, the warp or machine direction yarns are of rectangular, elliptical or D-shaped cross sections.

It is thus a primary object of the present invention to provide a dryer fabric having low permeability, good stability and good resistance to dirt.

It is another object of the present invention to provide a dryer fabric which can be easily cleaned.

It is still an object of the present invention to provide a dryer fabric made of multifilament yarns having similar properties to a dryer fabric made of monofilament yarns, that is excellent stability, high resistance to stretch, clean running and ease of cleaning.

It is yet an object of the present invention to employ synthetic yarns having different melting points in order to produce a dryer fabric having low permeability, excellent stability characteristics, and resistance to dirt.

These and other objects will become apparent from the following drawings and detailed description.

DETAILED DESCRIPTION OF THE DRAWINGS

Figure 1:
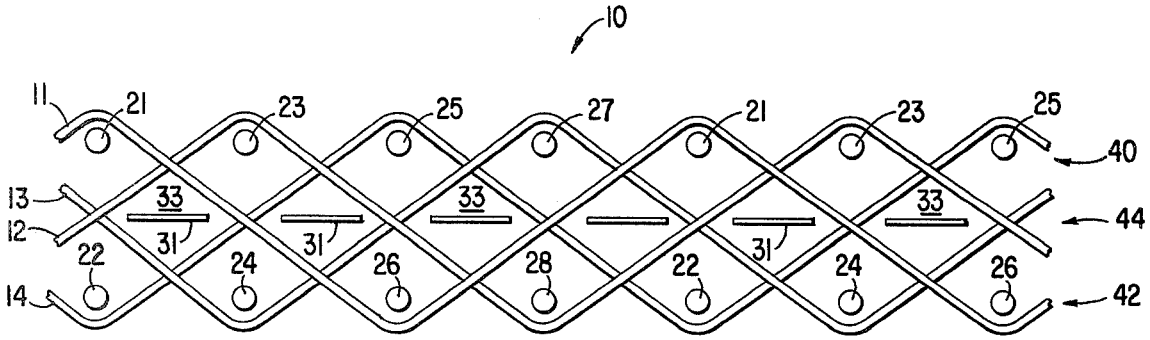
FIG. 1 is a schematic longitudinal section of a portion of a dryer fabric incorporating the teachings of the present invention through the use of low melt weft stuffer yarns, the fabric being shown prior to heat treatment.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
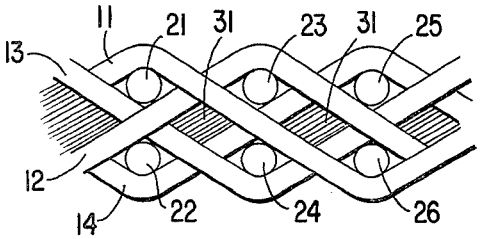
FIG. 2 is a schematic longitudinal section of a portion of the dryer fabric of FIG. 1, the fabric being shown in its final form.

With reference to FIGS. 1 and 2, a dryer felt or fabric, generally designated as 10, embodying the teachings of the subject invention, basically comprises a plurality of machine direction or warp yarns 11 through 14 interwoven with a plurality of cross-machine direction or weft yarns 21 through 28. As oriented in FIG. 1, weft yarns 21, 23, 25 and 27 define a top plane 40, whereas weft yarns 22, 24, 26 and 28 define a bottom plane 42. Stuffer picks 31 are selectively received in stuffer pick receiving sheds 33, defined within the fabric structure. Thus, depending on how you view them, either the stuffer picks 31 or the sheds 33 define an intermediate plane 44 disposed between the top plane 40 and the bottom plane 42.

Figure 3:
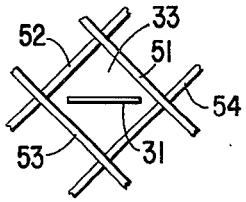
FIG. 3 is a schematic view used to explain the formation of the stuffer pick receiving sheds.

As shown in FIGS. 1–3, each stuffer pick receiving shed 33 extends in the weft or cross-machine direction, transverse of the fabric length. The sheds are arranged one next to the other throughout the full length of the fabric and are disposed intermediate between the top and the bottom planes 40 and 42. For example, with reference to FIG. 3, one such shed 33 is shown having four sides 51 through 54 with each side being formed by one of warp yarns 11, 12, 13 and 14. Each of the sheds 33 receives a specific stuffer pick 31. It is contemplated that, for some applications, some or all of the sheds may receive one or more stuffer picks, whereas, for other applications, some of the sheds may not receive any stuffer picks. Under any circumstances, however, each stuffer pick extends longitudinally throughout the full length of the shed.

Although the dryer fabric has just been described with reference to a specific weave pattern, it is to be understood that any weave design can be selected so long as the design is one which provides a fabric having a face or top surface, a bottom or back surface, and a center plane intermediate between the top and bottom surfaces. The center plane preferably is one capable of receiving weft stuffer picks, although, as will be explained hereinafter, the use of warp stuffer yarns is also contemplated and desirable.

A fabric woven in accordance with the teachings of the present invention, such as shown in FIGS. 1 and 2, makes use of high melting point synthetic monofilament or multifilament warp yarns 11 through 14 and similarly high melting point synthetic monofilament or multifilament face and back weft yarns 21 through 28. The weft yarns 31 in the center plane 44 are made up of lower melting point synthetic yarns in the form of monofilament yarns, multifilament yarns, slit synthetic film tape, split synthetic film tape, or combinations thereof.

As used herein, a slit-film yarn is a yarn of a flat, tape-like character typically produced by slitting an extruded film. Such yarns are well-known in the art, where a thin sheet of, for example, polypropylene is first extruded and then slit into tape before drawing. Likewise, as used herein, a split-film yarn is similar to a slit-film yarn in initial production; however, a split-film yarn goes through an extra heating and drawing process which causes the yarn to fibrillate in the longitudinal direction giving a lattice work appearance.

Typically, a slit-film yarn is similar to a piece of tape and is thus rigid in the cross direction. A split-film yarn, on the other hand, is relatively soft and easily deformed in the cross direction. For this reason, a split-film yarn is more readily deformed mechanically to fill a stuffer pick receiving shed during weaving.

The dryer fabric 10 is woven in a conventional manner on an appropriate loom and then subjected to a customary heat stabilization process. After weaving and prior to the stabilization process, the yarn components of the fabric are positioned relative to each other as shown in FIG. 1.

During the heat stabilization process, the fabric is exposed to sufficient heat to cause the low melting point stuffer yarns 31 to melt and flow. It should be noted, however, that the heat generated during the heat stabilization process is kept below the softening point of the high melting point yarns 11 through 14 and 21 through 28.

After the fabric has been subjected to the heat treatment process, the stuffer picks 31 have melted, flowed and reformed in such a way that they fill the voids or holes created by the sheds 33 where the stuffer pick has been inserted. Complete filling of all the voids would result in no permeability. Therefore, the filling is controlled to reduce permeability by a desired amount. The degree of filling depends on the size of the shed in relation to the size of the split-film yarn. By example, the shed size, which depends on the number of cross-machine direction yarns per inch, may be within the range of about 20 to 80 yarns/inch with a range of about 30 to 55 yarns/inch being preferred. Likewise, the size of the split-film yarn may be in the range of about 1,000 to 20,000 denier with a range of about 2,500 to 7,500 being preferred. At the same time, the flow of the molten synthetic stuffer pick 31 around and between the unmelted warp and weft yarns bonds the whole structure together, thereby improving fabric stability. Thus, it will be appreciated that the flow of the molten yarn should be sufficient to fill the voids while also covering a sufficient area to bind and lock the fabric structure. Finally, because the stuffer picks, after melting, reform into a solid mass with a smooth surface, the stuffer picks behave like a monofilament with regard to attraction of dirt on the paper machine. In this regard, the fabric runs cleaner.

In determining certain of the parameters to be used in selecting both the high melting point and low melting point synthetic yarns, it is important that the melting point of both the high and low melting components both be above the temperatures likely to be encountered on the paper machine, i.e., above 160° C. Preferably, the difference in melting points should be as wide as possible, but certainly not less than approximately 50° C. to allow for slight variations likely to occur in processing of the dryer fabric.

Examples of both high and low melting point synthetic yarns which have been combined according to the teachings of the subject invention and have yielded excellent results are as follows. The high melting point component is a polyester monofilament which softens at between 230°–240° C. and melts at approximately 260° C. The low melting point component is a polyolefin such as a polypropylene split-film yarn which softens at approximately 150° C. and melts at approximately 165° C.

Although the specific example just recited speaks in terms of a high melting point yarn, it is to be understood that yarns which do not melt, but instead degrade at a high predetermined temperature may be employed with desirable results. The primary criteria for the so-called high melting point yarn, be it one that actually melts or one that instead degrades, is that the alteration of the yarn take place at an alteration temperature higher than both that likely to be encountered on the paper machine and that at which the low melting point yarn actually melts. In addition, as in the case of the high and low melting yarns, the difference in temperature between the melting point of the low melting point yarn and the degradation or alteration point of the degrading yarn should be as wide as possible, but certainly not less than approximately 50° C. As an example of a degrading yarn, Nomex, an aramid yarn, could be used with polyester, with the polyester melting and flowing around the Nomex.

Figure 5:
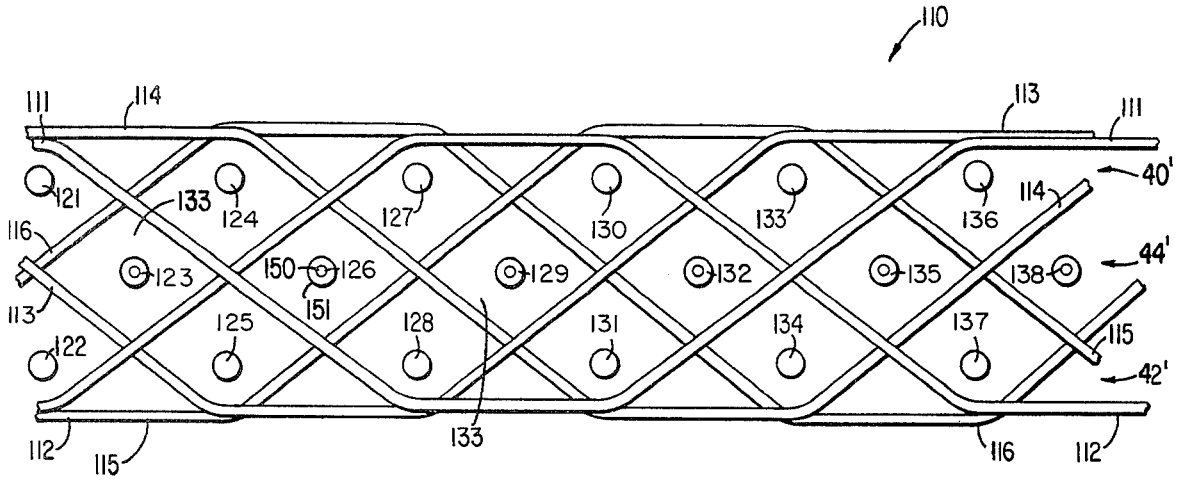
FIG. 5 is a schematic longitudinal section of a portion of a second dryer fabric incorporating the teachings of the present invention through the use of a low melt yarn disposed about a high melt or high degradation temperature core, the fabric being shown prior to heat treatment.

In addition to the use of slit or split film yarns as the stuffer picks 31, the use of a suitable low melt monofilament, multifilament or tape yarn wrapped around an inextensible core of material similar to the high melt or high degradation temperature materials mentioned hereinbefore, may be substituted. With reference to FIG. 5, an example of this arrangement is illustrated. FIG. 5 shows a second dryer felt 110 incorporating the teachings of the subject invention and basically comprising a plurality of machine direction or warp yarns 111 through 116 interwoven with a plurality of cross-machine direction or weft yarns 121 through 138. As oriented in FIG. 1, weft yarns 121, 124, 127, 130, 133 and 136 define a top plane 40', weft yarns 122, 125, 128, 131, 134 and 137 define a bottom plane 42' and stuffer picks 123, 126, 129, 132, 135 and 138 define an intermediate plane 44' disposed between top plane 40' and bottom plane 42'. The details of how the fabric in FIG. 5 is woven and the advantages created through such a pattern are explained in greater detail in co-pending U.S. patent application Ser. No. 258,047, filed Apr. 28, 1981, entitled "Papermakers Belt Formed From Warp Yarns Of Non-circular Cross Section", and incorporated by reference herein.

With continued reference to FIG. 5, each of the stuffer yarns, taking yarn 126 as exemplary, comprises an inextensible core 150 of a multifilament, monofilament, or spun staple fiber made from a material similar to the high melt or high degradation temperature materials referred to hereinbefore. The core 150 is wrapped with a suitable low melt component 151. The low melt component may be a multifilament yarn, a monofilament yarn, a slit-film yarn or a split-film yarn wrapped around the core throughout the full length of the core.

In a fabric such as that shown in FIG. 5, upon subjection to the heat treatment described hereinbefore, the wrapping of low melt material would melt and flow within the stuffer pick receiving sheds 133 which are defined in the fabric in a manner similar to those defined in the fabric of FIG. 1.

As an example of specific yarns for use in construction of the fabric in FIG. 5, the warp yarns 111 through 116 could be made in the form of a multifilament yarn, a monofilament yarn, or a yarn of non-circular cross section from a suitable material such as nylon or polyester. In like manner, the weft yarns, other than the stuffer picks, could be made from the same material in the same configurations as just mentioned. With regard to the stuffer picks, the inextensible core could be made from Nomex wrapped with a polypropylene multifilament yarn or could be wrapped with a polypropylene synthetic film yarn.

Figure 6:
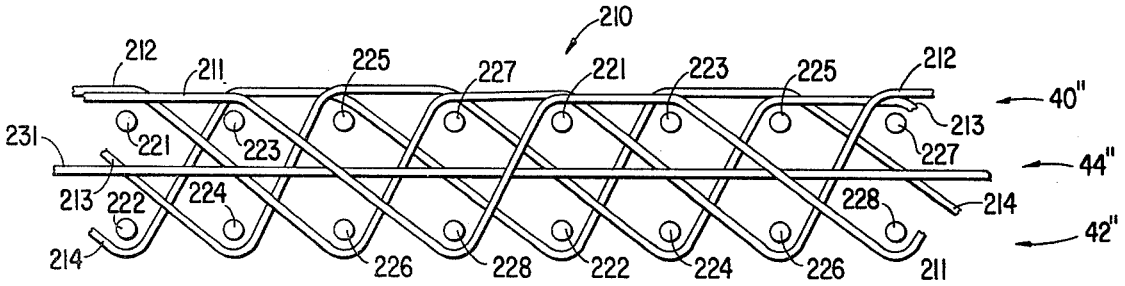
FIG. 6 is a schematic longitudinal section of a portion of a third dryer fabric incorporating the teachings of the present invention through the use of low melt warp stuffer yarns, the fabric being shown prior to heat treatment.

Yet another embodiment of the subject invention is illustrated in FIG. 6, which provides for the employment of the low melt yarns in a fabric which does not readily accommodate a stuffer pick.

FIG. 6 illustrates a third dryer fabric formed from a plurality of machine direction or warp yarns 211 through 214 which are interwoven with a plurality of cross-machine direction or weft yarns 221 through 228. Weft yarns 221, 223, 225 and 227 define a top plane 40'', and weft yarns 222, 224, 226 and 228 define a bottom plane 42''.

Interposed between the planes defined by the weft yarns are a series of machine direction warp stuffer yarns 231. As shown in FIG. 6, the insertion of one warp stuffer yarn is shown, however, it is to be understood that additional warp stuffer yarns could be employed.

The warp stuffer yarn 231 is made of a low melt material similar to the materials discussed hereinbefore. In like manner, the other warp yarns 211 through 214, as well as the weft yarns 221 through 228, may take the form of any of the high melt or high degradation temperature yarns discussed hereinbefore.

After weaving, the fabric of FIG. 6 would be subjected to a heat treatment in a manner similar to the other dryer fabrics discussed hereinbefore. Under the heat treatment, the stuffer warp 231 would melt and flow, thereby reducing permeability and increasing stability. Although the warp stuffer would not be confined in the same manner as the weft stuffer because of the lack of the stuffer pick receiving sheds, nevertheless, performance is satisfactory because of the very viscous nature of the low melt material and the resultant limit in the amount of flow.

Figure 7:
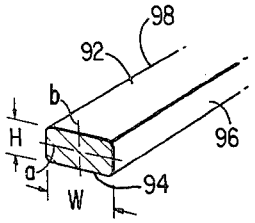
FIG. 7 is a perspective view of a portion of a warp yarn of non-circular cross-section for incorporation into a fabric made according to the teachings of the subject invention.

As stated before, it is contemplated that, for certain applications, the warp yarns may be replaced by synthetic monofilament warp yarns of non-circular cross section; examples of such yarns are those having a cross section in the form of an ellipse, a "D" or a rectangle, with a width to thickness ratio greater than 1:1 being preferred. Regarding the use of yarns of rectangular cross section in the warp direction on any of the embodiments of the subject invention, an example of a suitable rectangular warp yarn is shown and described in detail in the aforementioned co-pending U.S. patent application, which has already been incorporated by reference. With reference to FIG. 7, a portion of such a rectangular warp yarn is shown. Typically, the height H, as measured along axis b, of the yarn is 0.38 mm, whereas the width W, as measured along axis a, is 0.63 mm, thus providing a height-to-width ratio of 1:1.66. As shown in FIG. 7, the long axis, axis a, is generally parallel to the plane defined by the fabric, whereas the short axis, axis b, is generally perpendicular to axis a.

In terms of general inclusion of the rectangular warp yarns in a papermakers fabric, it has been observed that, because fibrillation takes place in rectangular yarns having a ratio greater than 1:2, such greater ratios should be avoided, and ratios in the range of 1:1 to 1:1.7 yield the best results.

In its position of intended use within any of the dryer fabrics already shown and described, the rectangular warp yarn has a top surface 92, a bottom surface 94, and two side surfaces 96 and 98. The top and bottom surfaces, which are of greater dimension than the side surfaces, typically are in contact with the weft yarns of the various weave patterns. In addition, depending on the endage count for the rectangular warp yarns, the spacing between the side surfaces of adjacent warp yarns may be varied, thus giving rise to a convenient way to control permeability.

The use of the flattened rectangular warp yarns in those fabrics which accept stuffer picks, for example, the fabrics illustrated in FIGS. 1 and 5, ensures that the stuffer pick receiving sheds 33 and 133 possess a much smoother interior surface. This may be attributed to be general flat nature of the surfaces of the rectangular warp yarns. Because of this construction, the stuffer pick receiving sheds tend to better control the flow of the low melt component, and thus give a better uniformity over the entire fabric in terms of permeability.

Although the present invention has been described primarily in the context of a dryer fabric, it is contemplated that other fabrics, such as forming fabrics and press felts, may be improved by incorporating the teachings of the subject invention.

In those applications where the papermakers belt must have a smooth surface, the lower melting point synthetic yarns are incorporated into the appropriate top or bottom layer. For example, with regard to FIG. 1, if a smooth top surface is desired, the weft yarns 21, 23, 25 and 27 are replaced by the lower melting point yarns 31. During heat treatment, the lower melting point yarns soften and melt and are smoothed out by a doctor blade. This is accomplished when a conventional doctor blade is placed into light contact with the surface of the fabric and removes surplus material or flattens the softened material by a light scraping action. Such a technique yields a very smooth surface, low permeability fabric below 50 cfm.

Figure 4:
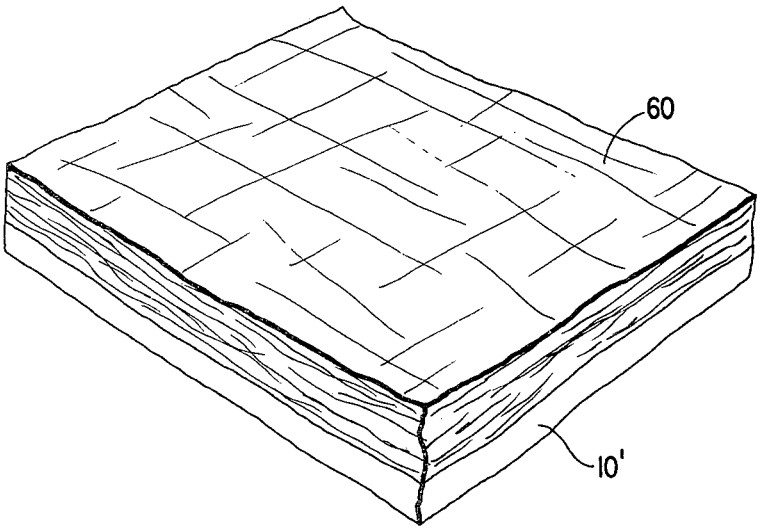
FIG. 4 is a perspective view, partially schematic, of a portion of a wet press felt incorporating the teachings of the present invention.

With regard to press felts, these felts are generally produced by needling a batt of fibers onto a base fabric to make something like a blanket. Such a batt 60 of fibers is illustrated in FIG. 4. The weave design of FIGS. 1 and 2 is advantageous as a base fabric 10', primarily because of the incorporation of the lower melting point yarns in the weft direction. As such, the low melt yarns could be in one or more of the various planes defined by the weft yarns, although, because of ease of control, the center or intermediate plane is preferred. The base fabric could be needled and heat-treated to a temperature sufficient to melt the lower melting point yarns. Upon melting, the yarns would act as a resin to lock the needled fibers and, thus, improve adhesion of the batt to the base fabric.

Although the present invention has been shown and described in terms of a specific preferred embodiment, it will be appreciated by those skilled in the art that changes and modifications are possible which do not depart from the inventive concepts described and taught herein. Such changes and modifications are deemed to fall within the purview of these inventive concepts.

What is claimed is:

1. A papermakers fabric comprising a plurality of machine direction and cross-machine direction yarns interwoven according to a preselected weave pattern to define a woven structure having at least a top layer and a bottom layer, a select number of the yarns of said weave pattern being synthetic yarns having a melting point lower than the alteration temperature of any of the remaining yarns of the fabric, said select number of yarns having been melted to flow around and between unmelted yarns and reformed within said woven structure for controlling permeability, said reformed yarns being bonded to unmelted yarns to lock said yarns together for enhanced fabric stability, and said unmelted yarns being unchanged by the melting of said select number of yarns.

2. The papermakers fabric of claim 1, wherein said yarns of said select number are all cross-machine direction yarns.

3. The papermakers fabric of claim 1, wherein said yarns of select number are machine direction yarns.

4. The papermakers fabric of claim 1, wherein said yarns of said select number are selected from the group consisting essentially of synthetic monofilament yarns, synthetic multifilament yarns, spun yarns, and synthetic film tapes.

5. The papermakers fabric of claim 1, wherein said yarns of said select number comprise yarns each having an extensible core surrounded by a material having a melting point lower than the alteration temperature of any of the remaining yarns of the fabric, said core being unchanged during the melting of said melt material.

6. The papermakers fabric of claim 1, wherein a number of said machine direction yarns are yarns of rectangular cross section with the long axis being parallel to the plane of the fabric.

7. The papermakers fabric of claim 1, further comprising a batt of fibers secured onto said woven structure.

8. A papermakers fabric comprising:

a first layer defined by a first plurality of weft yarns;

a second layer defined by a second plurality of weft yarns;

a plurality of warp yarns interwoven with said weft yarns to define a first surface of said first layer, a second surface of said second layer, and a plurality of stuffer pick receiving sheds interposed between said first and second layers; and a plurality of stuffer picks, each of said stuffer picks being made of a synthetic material having a melting point lower than the alteration temperature of any of the remaining yarns of said fabric, said stuffer picks having been melted to flow around and between unmelted yarns and reformed within said fabric for controlling permeability, said reformed picks being bonded and locked to unmelted yarns for enhanced fabric stability, and said unmelted yarns being unchanged by the melting of said stuffer picks.

9. The papermakers fabric of claim 8, wherein said stuffer picks are selected from the group consisting essentially of slit-film yarns, and synthetic split-film yarns.

10. A papermakers fabric comprising:

a first plurality of cross-machine direction yarns defining a top layer;

a second plurality of cross-machine direction yarns defining a bottom layer;

a third plurality of cross-machine direction yarns defining an intermediate layer betwen said top and bottom layers; and a plurality of machine direction yarns interwoven with said cross-machine direction yarns in accordance with a preselected weave pattern, a select number of said yarns of said third plurality being synthetic yarns having a melting point lower than the alteration temperature of any of the remaining yarns of the fabric, said select number of yarns having been melted to flow around and between unmelted yarns and reformed within said fabric for controlling permeability, said reformed yarns being bonded and locked to unmelted yarns for enhanced fabric stability, and said unmelted yarns being unchanged by the melting of said select number of yarns.

11. A papermakers fabric comprising a woven structure formed by weaving a plurality of machine direction and cross-machine direction yarns in accordance with a preselected weave pattern, said woven structure defining at least a top layer, an intermediate layer and a bottom layer, and bonding yarn means defined in only one of said layers, said bonding yarn means having been melted to flow around and between unmelted yarns and reformed within said woven structure for simultaneously controlling the permeability and stability of said fabric, and for locking said fabric structure together by means of said reformed yarns being bonded to unmelted yarns.

12. A papermakers fabric comprising:

a first layer defined by a first plurality of weft yarns;

a second layer defined by a second plurality of weft yarns;

a plurality of warp yarns interwoven with said weft yarns to define a first surface of said first layer and a second surface of said second layer; and a plurality of stuffer yarns, each of said stuffer yarns extending in the machine direction and being made of a synthetic material having a melting point lower than the alteration temperature of any of the remaining yarns of said fabric, said stuffer yarns bonded to one of said remaining yarns by having been melted to flow around and between unmelted yarns and reformed within said fabric to lock remaining yarns together for enhanced fabric stability, said unmelted, remaining yarns being unchanged by the melting of said stuffer yarns.

13. The papermakers fabric of claim 12, wherein said stuffer yarns are selected from the group consisting essentially of synthetic monofilament yarns, synthetic multifilament yarns, spun yarns, and synthetic film tapes.

14. A papermakers fabric comprising a plurality of machine direction and cross-machine direction yarns interwoven according to a preselected weave pattern to define a woven structure, a select number of said cross-machine direction yarns being slit-film yarns having a melting point lower than the alteration temperature of any of the remaining yarns of the fabric, said select number of yarns having been melted to flow around and between unmelted yarns and reformed within said woven structure for controlling permeability, said reformed yarns being bonded to unmelted yarns to lock said yarns together for enhanced fabric stability, said unmelted yarns being unchanged by the melting of said select number of yarns.

15. A papermakers fabric comprising a plurality of machine direction and cross-machine direction yarns interwoven according to a preselected weave pattern to define a woven structure, a select number of said cross-machine direction yarns being split-film yarns having a melting point lower than the alteration temperature of any of the remaining yarns of the fabric, said select number of yarns having been melted to flow around and between unmelted yarns and reformed within said woven structure for controlling permeability, said reformed yarns being bonded to unmelted yarns to lock said yarns together for enhanced fabric stability, said unmelted yarns being unchanged by the melting of said select number of yarns.

16. A papermakers fabric comprising a plurality of machine direction and cross-machine direction yarns interwoven according to a preselected weave pattern to define a woven structure, a select number of said yarns having a melting point lower than the alteration temperature of any of the remaining yarns of the fabric, said select number of yarns having been melted to flow around and between unmelted yarns and reformed within said woven structure for controlling permeability, said reformed yarns being bonded to unmelted yarns to lock said yarns together for enhanced fabric stability, said yarns of said select number each having an inextensible core surrounded by a low melt material, said core being unchanged during the melting of said melt material, and said unmelted yarns being unchanged by the melting of said select number of yarns.

17. A papermakers fabric comprising a plurality of machine direction and cross-machine direction yarns interwoven according to a preselected weave pattern to define a woven structure having a top layer defining a top surface, and a bottom layer defining a bottom surface, a select number of the yarns of at least one of said layers being synthetic yarns having a melting point lower than the alteration temperature of any of the remaining yarns of the fabric, said select number of yarns having been melted to flow around and between unmelted yarns and reformed on said woven structure for providing the surface associated with said layer with a smooth surface, said unmelted yarns being unchanged by the melting of said select number of yarns.

18. A papermakers fabric comprising:

a woven structure formed by weaving a plurality of machine direction and cross-machine direction yarns in accordance with a preselected weave pattern, said woven structure defining a top surface and a bottom surface;

a batt of fibers, said batt being disposed in contact with one of said top and bottom surfaces and being secured to said woven structure by needling certain of said fibers into said woven structure; and bonding yarn means interposed between said top and bottom surfaces and melted to flow around and between unmelted yarns and reformed for controlling the permeability of said woven fabric and for locking said needled fibers to said woven structure.

* * * * *